United States Patent [19]

Hasegawa

[11] 4,097,643

[45] Jun. 27, 1978

[54] COMPOSITIONS COMPRISING (1) A COPOLYMER FORMED FROM AN UNSATURATED ACID AND (2) AN EPOXY GROUP-CONTAINING SILANE ARE USEFUL TEXTILE AND PAPER FINISHING MATERIALS

[75] Inventor: Yoshiyuki Hasegawa, Ichihara, Japan

[73] Assignee: Toray Silicone Company, Ltd., Tokyo, Japan

[21] Appl. No.: 757,707

[22] Filed: Jan. 7, 1977

[30] Foreign Application Priority Data

Feb. 5, 1976 Japan ..... 51-10830

[51] Int. Cl.[2] ..... D06M 15/38

[52] U.S. Cl. ..... 428/270; 8/115.5; 8/115.6; 8/116 R; 8/120; 8/128 A; 8/DIG. 4; 8/DIG. 8; 8/DIG. 21; 428/272; 428/274; 428/514; 526/16; 526/29

[58] Field of Search ..... 526/16, 29; 8/115.5, 8/115.6, 116 R, 120, 128 A, DIG. 4, DIG. 8, DIG. 21; 428/270, 272, 274, 514

[56] References Cited

U.S. PATENT DOCUMENTS 4,043,953 8/1977 Chang et al. ..... 526/29

*Primary Examiner*—J.C. Cannon

*Attorney, Agent, or Firm*—Robert L. McKellar

[57] ABSTRACT

An improved composition is disclosed which consists of organic resins and silanes. The compositions are useful finishing resins for textiles, fibers and paper. An example of the improved composition is a copolymer resin containing at least one type of acrylic acid ester combined with at least one type of unsaturated aliphatic acid and, a silane containing epoxy groups.

7 Claims, No Drawings

COMPOSITIONS COMPRISING (1) A COPOLYMER FORMED FROM AN UNSATURATED ACID AND (2) AN EPOXY GROUP-CONTAINING SILANE ARE USEFUL TEXTILE AND PAPER FINISHING MATERIALS

This invention is related to compositions for resin finishing. More specifically, this invention is related to resin finishing compositions which consist of copolymer resins containing at least one type of acrylic acid ester or methacrylic acid ester combined with at least one unsaturated aliphatic acid and, a silane which contains epoxy groups.

Organic resins, of the type hereafter described in detail in this specification, which are derived from acrylic acid esters or methacrylic acid esters and unsaturated aliphatic acids are well known in the textile treatment art. Various combinations of the acrylate esters with the unsaturated aliphatic acids to form acrylic copolymers tend to give varying degrees of softness and flexibility to the final films formed therefrom.

Also, these acrylic copolymers give some degree of transparency to the final films and they lend themselves well to being formed in emulsions as well as solvent systems. It is very obvious then why these materials have become very popular in treating textiles, fibers and paper.

As with most chemical systems, there are some shortcomings also associated with these acrylic copolymers. One such disadvantage is the inability of these materials to be readily cured on the various substrates. Usually, catalysts such as calcium chloride or aluminum chloride are required which help to keep the cure temperature low in order that the substrate is not affected or destroyed. There is, however, a further disadvantage in using catalysts in this system because they tend to leave residues in the cured transparent film and they cause the applicator baths to cure prematurely so that useful bath life is very short. In addition, wash resistance and water resistance in the final product are adversely affected.

Another system that has been used is the combination of the acrylic copolymers with cross-linking agents under the influence of heat. Such cross-linking agents can be, for example, methylol melamine, methylol urea, methylol alkylene ureas, methylol urone and formalin. This system when heated forms three-dimensional networks and the final product shows increased wash resistance and dry cleaning resistance.

It has been found however that the acrylic copolymers when heated to the temperatures required to give cross-linking are affected by the high temperature and when the heat is too high the substrate is affected or destroyed. On the other hand, lower temperatures tend to give insufficient cross-linking and performance characteristics of the final film are affected. Moreover, the formaldehyde formed as a by-product in such cross-linking cures is a definite health hazard.

Thus, a way has been found to adequately cure the acrylic copolymers to give optimum performance characteristics while overcoming the problems and disadvantages described above.

Thus this invention discloses to the art an improved resin for resin finishing textiles, fibers and paper which is a composition of matter which consists essentially of (A) copolymeric organic resins which are prepared from unsaturated aliphatic organic acids and an ester selected from the group consisting of (i) acrylic acid esters and (ii) methacrylic acid esters, the improvement comprising the addition of (B) 0.1–10 weight percent, based on the weight of the components (A) and (B), of a silane which contains epoxy groups.

The copolymeric organic resins i.e. the acrylic copolymers (A) are known as agents for the finishing of textiles and the like. Such materials can be prepared, for example, from acrylic acid esters such as methyl acrylate, ethyl acrylate, propyl acrylate or butyl acrylate. There can also be used methacrylic acid esters such as methyl methacrylate, ethyl methacrylate, propyl methacrylate, butyl methacrylate, octyl methacrylate, cyclohexyl methacrylate or mixtures of any of these acrylates or methacrylates.

They are copolymerized with unsaturated aliphatic acids, for example, acrylic acid, methacrylic acid, crotonic acid, isocrotonic acid, 4-pentenoic acid, 5-hexenoic acid, maleic acid, fumaric acid and itaconic acid.

In addition to the above, the resin (A) can be further modified by the addition of ethylene, propylene, vinyl chloride or vinyl acetate as copolymer components.

The preferred resins have at least one type of acrylic acid ester or methacrylic acid ester as the main component and at least one unsaturated aliphatic acid as the secondary component and preferably, the resin should contain a free carboxyl content of at least 0.15 weight percent. These resins should preferably be in liquid form but either liquid or solid (at room temperature) can be used. Such acrylic copolymers are discussed in detail in U.S. Pat. No. 3,377,249 and elaborate details as to their preparation, the appropriate ratios of acrylic acid esters and aliphatic organic acids and reaction conditions is not believed to be necessary in this specification. Those skilled in the art can readily prepare such acrylic resins from the teaching of the U.S. patent and the examples in the instant specification.

The component (A) is preferably present in the composition at 90.9 to 99.9 weight percent based on the weight of (A) and (B).

Various combinations of the acrylic and/or methacrylic esters with unsaturated aliphatic acids give resins which have softness and flexibility when cured into films which in turn give the final product highly acceptable "hand". "Hand" is a term of the art and it simply means the feeling one gets when a substrate treated with a material is touched with the hands. A soft, flexible, very pliable material is "good hand" and a more coarse, boardy feeling is "lack of hand".

The resins are known to give transparent films. They also give some degree of heat resistance and photochemical resistance when properly cured. In some cases, the resins have secondary transition points below room temperature thus eliminating the need to use plasticizers. They are also known to give excellent adhesion to some substrates.

Component (B), the silane which contains epoxy groups are known organosilicon compounds in which an organic group containing an epoxy group and 2 or 3 alkoxy groups or substituted alkoxy groups are bonded to the same silicon atom. Such silanes can be, for example, γ-glycidoxypropyltrimethoxysilane, γ-glycidoxypropyltriethoxysilane, γ-glycidoxypropylmethyldimethoxysilane, γ-glycidoxypropyldiethoxymethoxysilane, γaglycidoxypropyltriisopropoxysilane, β-(3,4-epoxycyclohexyl)ethyltrimethoxysilane, γ-(3,4-epoxycyclohexyl)propyltrimethoxysilane, β-(3,4-epoxycyclohexyl)ethylmethyldimethoxysilane and β-(3,4-epoxycyclohexyl)propyltriethoxysilane.

Component (B) is preferably used in the amount of 0.1–10.0 weight percent based on the weight of components (A) and (B). When the amount of (B) is less than 0.1 weight percent, the solvent resistance of the cured film is adversely affected. When the amount of (B) is greater than about 10 weight percent the use of such material becomes economically unpractical. Especially preferred amounts of (B) in the final resin before cure are 0.2 to 2.0 weight percent.

The resin finishing composition of this invention is prepared by simply mixing component (A) with component (B) in the proper ratios. If it is preferred, however, other methods may be used to obtain the resin. For example, component (B) can be added to a solution of component (A) in a solvent such as water, a lower alcohol, n-hexane, xylene or trichloroethane or, component (B) can be added to an emulsion of component (A) which has been prepared beforehand with emulsifiers and water or, component (B) can be added to component (A) which has been prepared beforehand by emulsion polymerization.

In addition to components (A) and (B) above, it is within the scope of this invention to have other commonly used ingredients present in the resin composition such as dyes, bath stabilizers, curing promoters and the like.

The mixing of the above components should be carried out at room temperature or with slight heating. Heating at temperatures in excess of 50° C should be avoided. Compositions prepared in this manner can be stored for long periods of time.

The resin composition of this invention can be applied to textiles, fibers or paper by impregnating, spraying or coating. It is then heated at 90°–150° C. for a time ranging from a few minutes to 50–60 minutes.

The resin finishing compositions of this invention are suitable for shrinkage resistant finishes, wrinkle resistant finishes, the improvement of hand and weather resistance of fiber products including cotton, linen, rayon, wool, nylon and polyesters. It can also be used for imparting wrinkle resistance and dimensional stability to paper.

The present invention will now be described in detail by reference to the following examples.

This invention will be explained below with the description of experimental examples.

EXPERIMENTAL EXAMPLE 1

0.2 part by weight (0.4 weight percent) of γ-glycidoxypropyltrimethoxysilane was added to 100 parts by weight (99.6 weight percent) of an emulsion containing 50 wt% of a copolymer resin containing methyl methacrylate, butyl methacrylate and acrylic acid in a molar ratio of 16:80:4. The mixture was stirred until homogeneous.

A plain woven fabric of cotton was immersed in the resin finishing composition obtained by the abovementioned procedure, and then the solution was squeezed out with a pair of rollers to leave the fabric with a wet pick-up percentage of 75%.

The fabric was dried at 60° C. for 4 hours. Then it was heat treated for 5 minutes at 140° C. Next the fabric was washed for 10 minutes with soap at 80° C., rinsed with water, and dried at 50° C. for 4 hours. The cotton plain woven fabric had a good hand with shrinkage resistance and wrinkle resistance.

The hand, shrinkage resistance and wrinkle resistance of the plain woven cotton cloth did not decrease as a result of washing or dry cleaning.

EXAMPLE 2

0.2 part by weight (1.16 weight percent) of β-(3,4-epoxycyclohexyl)ethyltrimethoxysilane was added to 99.8 parts by weight (98.83 weight percent) of a toluene solution of 17 wt% of a copolymer which consisted of methyl methacrylate, butyl acrylate and methacrylic acid in a ratio of 6:88:6. by thorough stirring and mixing, a resin finishing composition was prepared.

This mixture was poured into a shallow mold to a depth of 4 mm and left for 24 hours at room temperature. After toluene had been removed, the material was heat treated at 120° C. for 3 minutes to produce a transparent film.

This film was cut into a 2 cm square and immersed in perchloroethylene at room temperature for one hour. The film swelled to 3.2 cm × 3.2 cm, but did not dissolve.

As a control, a film was prepared from the toluene solution of the above copolymer alone under conditions otherwise the same. This film was completely dissolved in perchloroethylene after 2 minutes of immersion. The above results are sufficient proof of the dry cleaning resistance of the fiber products treated with the resin finishing compositions of this invention.

EXAMPLE 3

Various resin finishing solutions in which one component was an emulsion containing 45 wt% of copolymer consisting of methyl methacrylate, butyl methacrylate and crotonic acid in a molar ratio of 10:88:2, and the other component was either one of various silanes containing epoxy groups or an aqueous solution of a conventional crosslinking agent. The ratios of these components in these resin finishing solutions are given in Table I in parts by weight. (Samples 7, 8 and 9 are control examples.)

Each sample was put into a square shaped vat, and No. 131 filter paper manufactured by Toyo Roshi Kaisha, Ltd., was immersed in the vat liquid for 3 minutes. The solution was squeezed out of paper with squeezing rollers leaving a 180% (based on the weight of the paper) coating solution.

The paper was then predried at 60° C. for 30 minutes and immediately afterward subjected to a heat treatment at 150° C. for 2 minutes. Then it was left in an air chamber at 25° C. and 65% RH. The thus treated Toyo Roshi No. 131 paper was cut to a size of 4 cm × 12 cm and was subjected to a tensile test according to the specifications of JIS L 1068 at a tensile rate of 10 cm/min.

In addition, the same Toyo Roshi No. 131 paper was immersed in water maintained at 90° C. for 30 minutes, and after the paper was dried in air its water repellency was tested according to JIS L 1004. The results are shown in Table I.

TABLE I

| Sample | *Component ratios (parts by weight) (weight percent) | | | | | | | |
|---|---|---|---|---|---|---|---|---|
| | A | B | C | D | E | F | G | H |
| 1 | 230 (98.1) | 2 | — | — | — | — | — | 768 |
| 2 | 230 (99.5) | 0.5 | — | — | — | — | — | 770 |
| 3 | 230 | 0.2 | — | — | — | — | — | 770 |

TABLE I-continued

| | *Component ratios (parts by weight) (weight percent) | | | | | | | |
|---|---|---|---|---|---|---|---|---|
| | (99.8) | | | | | | | |
| 4 | 230 | — | 0.6 | — | — | — | — | 770 |
| | (99.4) | | | | | | | |
| 5 | 230 | — | — | 0.8 | — | — | — | 770 |
| | (99.2) | | | | | | | |
| 6 | 230 | — | — | — | 0.8 | — | — | 770 |
| | (99.2) | | | | | | | |
| 7 | 230 | — | — | — | — | — | — | 770 |
| 8 | 230 | — | — | — | — | 20 | — | 750 |
| 9 | 230 | — | — | — | — | — | 70 | 700 |

Observed Values

| Sample | Breaking strength (kg) | Breaking elongation (%) | Degree of water repellency | Formaldehyde odor |
|---|---|---|---|---|
| 1 | 29.0 | 9.0 | 100 | None |
| 2 | 26.0 | 10.2 | 90 | None |
| 3 | 21.0 | 14.0 | 80 | None |
| 4 | 28.4 | 8.6 | 90 | None |
| 5 | 30.1 | 11.0 | 100 | None |
| 6 | 32.3 | 10.0 | 90 | None |
| 7 | 19.7 | 14.0 | 0 | None |
| 8 | 25.0 | 9.2 | 50 | None |
| 9 | 27.0 | 10.0 | 70 | Strong |

*A Emulsion (weight percent)
B γ-glycidoxypropyltrimethoxysilane
C γ-glycidoxypropylmethyldimethoxysilane
D β-(3,4-epoxycyclohexyl)ethyltrimethoxysilane
E γ-(3,4-epoxycyclohexyl)propyltrimethoxysilane
F Aluminum chloride (2.5% aqueous solution)
G Methylol melamine (5.0% aqueous solution)
H Water

EXAMPLE 4

When these products are compared with a resin finished product which has been cured by the addition of a divalent or trivalent metal salt such as calcium chloride or aluminum chloride, the active life of the treatment bath is found to be substantially longer with the product of this invention, and the product shows quite superior wash fastness and water fastness.

EXAMPLE 5

A comparison of the products of this invention with the resin-finished products obtained by curing carried out with the addition of methylol melamine, methylol urea, a methylol alkylene urea or methylol urone show that these products are advantageous from a health standpoint because they do not evolve formaldehyde during or after the curing process.

That which is claimed is:

1. An improved resin for resin finishing textiles, fibers and paper which is a composition of matter which consists essentially of (A) copolymeric organic resins which are prepared from unsaturated aliphatic organic acids and an ester selected from the group consisting of (i) acrylic acid esters and (ii) methacrylic acid esters, the improvement comprising the addition of (B) 0.1–10 weight percent, based on the weight of the components (A) and (B), of a silane which contains epoxy groups.

2. A resin as claimed in claim 1 wherein (A) is composed of methyl methacrylate, butyl methacrylate and acrylic acid and (B) is γ-glycidoxypropyltrimethoxysilane.

3. A resin as claimed in claim 2 wherein (A) is composed of methyl methacrylate, butyl methacrylate and acrylic acid in a ratio of 16:80:4 and (B) is present in an amount of 0.4 weight percent based on the weight of (A) and (B).

4. An improved resin for resin finishing textiles, fibers and paper which is a composition of matter which consists essentially of 90–99.9 weight percent of (A) which is a copolymeric organic resin which is prepared from an unsaturated organic acid and an ester selected from a group consisting of (i) acrylic acid esters and (ii) methacrylic acid esters, the improvement comprising the addition of (B) 0.1–10 weight percent of a silane which contains epoxy groups, the amount of (A) and (B) being based on the total weight of (A) and (B) in the composition.

5. A resin as claimed in claim 4 wherein (A) is composed of methyl methacrylate, butyl methacrylate and acrylic acid and (B) is γ-glycidoxypropyltrimethoxysilane.

6. A resin as claimed in claim 5 wherein (A) is composed of methyl methacrylate, butyl methacrylate and acrylic acid in a ratio of 16:80:4 and (B) is present in an amount of 0.4 weight percent based on the weight of (A) and (B).

7. A textile when treated with the composition of claim 4 wherein the textile is selected from a group consisting of cotton, linen, rayon, wool, nylon and polyester.

* * * * *